United States Patent [19]

Irwin et al.

[11] 4,013,541

[45] Mar. 22, 1977

[54] METHOD AND APPARATUS FOR WAX DEOILING

[76] Inventors: Roy E. Irwin, 1456 Lakeshore Highway East, Oakville, Ontario, Canada; Alfred Aufhauser, 8 E. 83rd St., New York, N.Y. 10028

[22] Filed: Dec. 9, 1975

[21] Appl. No.: 639,201

Related U.S. Application Data

[63] Continuation-in-part of Ser. No. 484,217, June 28, 1974, Pat. No. 3,926,776.

[52] U.S. Cl. ..... 208/32; 196/14.5

[51] Int. Cl.[2] ..... C10G 43/04

[58] Field of Search ..... 208/30, 32; 196/14.5

[56] References Cited

UNITED STATES PATENTS 3,926,776 12/1975 Irwin et al. ..... 208/32

*Primary Examiner*—Herbert Levine

*Attorney, Agent, or Firm*—Kenyon & Kenyon

[57] ABSTRACT

Deoiling of slack wax or other similar wax composition is accomplished while the wax is confined in a series of cells which are spaced apart by only one-sixteenth to one-half inch and which are vertically or otherwise disposed for drainage along the surfaces thereof from an upper margin to a lower margin. The spaces between the plates are filled to a depth of 4 to 24 inches, preferably 6 to 12 inches, with wax in the melted state while the spaces between the plates are closed off at their lower margins by a body of liquid, preferably a body of the wax, that is of substantial depth underneath the lower margins of said plates and is maintained in contact with the lower margins of the plates. The temperature of the plates is then lowered by lowering the temperature of a temperature-controlling fluid such as water that is flowed through a multiplicity of conduits that traverse the plates in thermally-conductive relation therewith with concomitant solidification of the wax between the plates. While the wax is confined in the solid state the body of liquid is removed, which removal may be facilitated by application of heat in the case of a liquid such as wax. After removal of the body of liquid the temperature of the wax between the plates is gradually increased by gradually heating the temperature-controlling fluid with concomitant drainage of the lower melting point constituents from the spaces between the plates for their recovery separated from the higher melting point constituents which remain between the plates and which are subsequently recovered by raising the temperature of the temperature-controlling fluid to a still higher temperature until the higher melting point wax components are melted for drainage and recovery separated from the lower melting point constituents.

8 Claims, 3 Drawing Figures

METHOD AND APPARATUS FOR WAX DEOILING

CROSS REFERENCE TO RELATED APPLICATION

This application is a continuation-in-part of application Ser. No. 484,217 filed June 28, 1974 now U.S. Pat. No. 3,926,776.

FIELD OF THE INVENTION

This invention relates to the separation of lower melting point constituents (generally oil and isoparaffins) of a slack wax for the recovery of a deoiled commercially acceptable paraffin wax.

The invention makes refined paraffin waxes from slack waxes by a novel method and apparatus requiring a low cost installation and giving yields comparable to those accomplished in a solvent deoiling process.

BACKGROUND OF THE INVENTION

Solvent dewaxing of lubricating oil distillates results in the occurrence of large quantities of slack wax. Slack wax is a mixture containing isoparaffins, normal paraffins and also lower melting point constituents usually referred to as oils and naphthenic constituents. The slack wax may contain from about 5–25% of oil as determined by ASTM test No. D 721.

For many years it has been known that the oil content of some oil-containing waxes may be reduced by resort to the so-called sweating process. This, essentially, involves providing a mass of the oil-containing wax at a temperature sufficiently low for it to be solid and then very gradually raising the temperature of the solidified mass whereby the components of lower melting point will tend to become liquefied and drain away at least in part from the higher melting point wax. While there have been various proposed procedures for accomplishing sweating, it has been recognized that sweating, at least as heretofore practiced, is very inefficient and time-consuming. The time required for processing a given stock completely may vary from several days to as long as several weeks. The wax sweating as heretofore carried out also is inefficient in that the separation of the oil and other lower melting point constituents is far from complete, with the result that in order to reduce the oil content of the hard wax to desired specifications it is not unusual to employ several successive sweating operations. The disadvantages incident to sweating as a method for reducing the amount of low melting point constituents in a wax composition such as slack wax has led the industry to place reliance for the most part on the solvent extraction procedure wherein a wax such as slack wax is dissolved in a solvent such as methylethylketone (or methylisobutylketone) followed by chilling the solution to cause precipitation of the desired portion of the wax which is filtered out using a rotary vacuum filter. For most purposes solvent extraction does not reduce the oil content of the wax to a sufficient extent in one stage and the wax-rich product resulting from the initial extraction is reslurried at least once with additional solvent followed by cooling and subsequent filtration. By two or more successive operations the resulting product is expected to contain less than 1% of oil. As compared with the equipment required for this invention, the equipment for solvent extraction requires a very substantially greater capital investment. Moreover, the equipment used for solvent extraction as a matter of economics does not lend itself to the economic construction of processing equipment for small-scale operation.

It is apparent from the foregoing there has been a recognized need for a deoiling procedure applicable to slack wax or the like which would be comparable in effectiveness to the solvent extraction procedure but which could be installed and placed in operation at much less expense and which lends itself not only to large-scale operations but also to scaled-down operations.

GENERAL STATEMENT OF INVENTION

It is a principal object of this invention to provide improved method and apparatus whereby lower melting point constituents may be removed from a wax composition such as slack wax at much less expense for equipment and plant installation as compared with the requirements for solvent extraction but at comparable operating costs and yields.

It is a further and more particular object of this invention to improve upon prior procedures so as to realize very substantial economic advantages not only as compared with prior sweating procedures but also as compared with the solvent extraction procedure.

A still further object of this invention is to provide an economic procedure for deoiling slack wax or similar wax composition which may be employed to advantage as to the production of lubricating oil distillates. In the manufacture of lubricating oils the various section units including those for accomplishing distillation, solvent extraction for the removal of low viscosity index oils, dewaxing the extracted oils or raffinates and final finishing by clay treatment of hydrogenation are fairly balanced to capacity in each section to produce the maximum throughput of finished oils. If a refiner wishes to make hard or refined waxes from the slack waxes, it is necessary to stop the operation of lubricating oil production and carry out a blocked operation to produce the refined paraffin waxes unless the refiner has gone to the expense of providing deoiling equipment that can be used for this purpose and that is of sufficient capacity to complement the continuous production of lubricating oil. Deoiling by sweating as heretofore known and practiced has not been regarded as feasible for this purpose because it is so inefficient and time-consuming. The solvent extraction procedure for deoiling slack wax is more expeditious but the equipment cost for doing so at a capacity commensurate with the continuous production of lubricating is so great coupled with the relatively slow amortization of such equipment that refiners are hesitant to install such equipment for the special purpose of wax deoiling. The improvements afforded according to this invention make it possible to accomplish the deoiling of slack wax much more rapidly as compared with prior sweating procedures at an equipment cost that is only a fraction of the cost of solvent extraction deoiling equipment. And since the operating cost is less, this invention makes it possible for the first time to accomplish the deoiling of slack waxes on an economically feasible basis without interrupting the recovery of lubricating oil distillates.

In the practice of this invention a body of slack wax or the equivalent is confined so as to be caused to occur in the form of a slab which ranges in thickness from about one-sixteenth inch to one-half inch and the width of which is of the order of 4 to 24 inches. The slab is confined between surfaces, the temperature of which is subject to control, and the slab as so confined is so disposed that drainage of oil or other lower melting point constituents occurs across the aforesaid width of the slab which provides a depth of about 4 to 24 inches going from the upper margin to the lower margin. The length of the slab is not critical and may be determined according to the desired size of the plant installation. Thus, the length of the slab may range from only a few inches to as long as 30 feet or more. The lower margin of the slab as thus held between the two surfaces is open in order to permit such lower melting point constituents as may become formed to drain therefrom for collection in a suitable receptacle. The upper margin of the device is open so that the space between the surfaces may initially be filled with a charge of slack wax or recycled wax by flowing it in when in the melted state. The slack wax or recycled wax is cooled by means of the conduits to become a solid mass having a temperature usually several degrees lower than the melting point of the wax in process. At this time the temperature of the surfaces which confine the slab of wax is gradually increased from an initial temperature at which the wax is solid through temperatures at which the lower melting point of constituents tend become selectively melted. An environment is provided wherein the lower melting point constituents as they become reduced to the liquid state find escape paths such that their removal is much more effective and rapid as compared with the wax sweating procedures heretofore used.

In our commercial installation the thin slabs of oil-containing wax are confined in the spaces between a succession of plates or sheets which are vertically disposed and which are spaced from each other so as to afford a battery of cells wherein the spacing between the plates is the aforesaid distance of about one-sixteenth inch to about one-half inch, the width of each of the plates being such that a slab of wax may be confined between them which, as aforesaid, is of the order of 4 inches to 24 inches in depth from its upper margin to its lower margin. The spaces between the plates are open at the top and at the bottom. While the spacing between the plates may be even less than one-sixteenth inch, the overall operation becomes most costly. If the spacing exceeds one-half inch, difficulties may be encountered because of increased tendency of the wax to prematurely drop out and the rate of heat transfer is lower than desired. Moreover, the drainage of the lower melting point constituents becomes less efficient with wider spacing. Preferably the spacing between the plates is from about one-eighth inch to one-fourth inch. In like manner the drainage of the lower melting point constituents becomes less efficient and the yield becomes decreased if the depth of the cell across which drainage occurs is substantially greater than 24 inches. Ordinarily the cells are produced so that the depth across which drainage occurs is of the order of 6 inches to 12 inches. In a commercial installation it ordinarily is the case that the cell plates are disposed with the width across which drainage occurs at or close to the true vertical, namely, 90° to the horizontal. However, while this is preferred, it is not critical. Thus satisfactory results have been obtained when the plates are disposed so that the width across which drainage occurs is at an angle of 45° to the horizontal. Accordingly, the term "vertically disposed" as used herein and in the claims is to be understood as comprehending any disposition of the plates other than the true vertical so long as the vertical disposition relative to the horizontal is sufficient to induce effective gravitational drainage of the lower melting point constituents leaving the desired hard wax within the cells.

The temperature of the plates is controlled by conduits for a temperature-controlling fluid which may be gaseous such as high velocity air but preferably is a fluid such as water. These conduits successively traverse the plates of the battery of cells and the cells between the plates and they are distributed about the plates in thermally conductive relation therewith so that the entire surface of each plate may have its temperature controlled substantially uniformly throughout. The conduits typically are in the form of pipes about one-fourth inch to three-fourths inch in internal diameter and distributed so that there are sufficient pipes to maintain rapid heat transfer. The conduits are supplied with the temperature-controlling fluid in any suitable way, as by the employment of a header that is connected with a source which supplies fluid at the desired temperature for use during the different phases of the deoiling process. Similarly, the conduits discharge into a complementary header from which the fluid may be returned so as to be recycled. The plates may be made of any suitable structural heat-conductive material. Ordinarily the plates are in the form of sheets of a metal such as tinned copper, tinned brass, aluminum, stainless steel, or protected iron. Best results are obtained by the use of a material having a high degree of thermal conductivity. Plates or sheets of tinned copper or of aluminum are preferred. For similar reasons the conduits preferably are made from tinned copper or aluminum.

The battery of cells may be filled with the wax when it is at a temperature somewhat above its melting point. In order that the heat-liquefied wax may remain confined in the space between the plates, the container below the battery of cells is adapted and arranged so that it may maintain therein a body of liquid which contacts the lower margins of the plates and closes off the spaces between the plates along their lower margins so that the melted wax that is introduced into the spaces between the plates may remain therein at the aforesaid proper depth. In the practice of the present invention the body of liquid used to close off the spaces between the plates along their lower margins preferably is a portion of the same wax that is introduced into and remains confined between the plates. In usual practice it is convenient to introduce the wax into the container until the resulting body of melted wax contacts the lower margins of the plates and merely continue introduction of the melted wax until the wax fills the spaces between the plates to the desired depth. During this operation the plates may be maintained at a temperature below the melting point of the wax, although this is not essential. In any case, after the wax has been introduced into the spaces between the plates, the temperature of the temperature-controlling fluid is caused to be at a temperature at which the wax in the spaces between the plates becomes solidified. While the wax between the plates remains solidified the body of liquid in the receptacle is removed. When the body of liquid is a body of the wax it may be returned to the tank which supplies the slack wax or it may be used in any other suitable way as, for example, by discharge into another battery of cells. In order that the wax may be readily removed, the body of wax in the container preferably is heated so that its temperature will be above its melting point, thereby increasing its flowability. Such heating of the body of wax does not affect the solidifed wax in the spaces between the plates since the plates are maintained by the temperature-controlling fluid at a temperature sufficiently low to maintain the wax between the plates in the solid state.

While in the practice of this invention it is preferable to employ a body of the slack wax itself to close off the spaces between the plates so that the spaces may be filled to proper depth, any other liquid may be used which is compatible with and is not mutually soluble with the slack wax and which is effective to close off the spaces between the plates along the lower margins of the plates. As described in our application Ser. No. 484,217, cold water may be used. However, the employment of the slack wax itself is preferable. By the employment of the wax itself the equipment is simpler in that there is no necessity for handling another liquid such as water and the desired de-oiling may be accomplished in a unit of simpler construction which in effect provides a single closed container for the wax. Such a unit is of further advantage in that it lends itself to being completely insulated and in not being subject to varying ambient temperatures. Moreover, the wax during treatment can be readily enclosed so as to prevent the escape of volatile constituents of the slack wax.

While the practice of this invention is to be regarded as generally applicable to the removal of lower melting point constituents from certain wax compositions, it is especially adapted for use in connection with the deoiling of slack wax of the type that occurs during the production of lubricating oil distillates. Such slack waxes usually have a melting point in the range from about 112° to 140° F. The oil content may be from about 5% to about 30%. However, the amount and nature of the lower melting point constituents such as oil and isoparaffins varies depending on the source from which the slack wax was obtained, and the method of refining. The objective of the complete deoiling procedure is to recover the hard wax, generally normal paraffins wherein the oil content has been reduced to a prescribed value such as ½ to 1%.

In the practice of this invention wherein a body of the slack wax to be deoiled is employed to close off the spaces between the plates at or adjacent the lower margins thereof a battery of the spaces plates extends across a container with the lower margins of the plates spaces substantially from the bottom of the container so that the portion of the container below the lower margins of the plates constitutes a tray or pan for receiving any lower melting point constituents, e.g., foots oil, that may drain from the wax confined in the spaces between the plates, which spaces are open along the lower margins of the plates in substantially spaced relation with respect to the container. The slack wax is heated to a temperature about 15° F. above its melting point and is introduced into the container so as to fill the tray portion of the container until a body of the wax is formed that is in contact with the lower margins of the plates and until the spaces between the plates are filled to the proper depth. It is convenient to employ plates which have the desired width from the lower margin to the top, e.g., 12 inches, so that the wax between the plates will be 12 inches in depth when the spaces between the plates are filled. It also is convenient to provide a wax overflow line from the container from which the wax flows when the wax between the plates reaches the tops of the plates or otherwise attains the desired depth. At the same time the temperature-controlling fluid such as water is maintained at a temperature of about 50° to about 80° F. below the melting point of the wax and is caused to flow through the conduits of the cell battery, thereby causing the wax in the spaces between the plates to become solidified. The temperature of the solidified wax may, for example, be about 10° to about 20° F. below its melting point.

While the wax in the spaces between the plates is in the solid state as the result of the cooling effect of the temperature-controlling liquid, the wax in the tray portion of the container is removed through a suitable outlet and to accelerate the removal of the wax and to offset any partial solidification of the wax immediately below the lower margins of the plates, the wax in the tray is heated as by out-of-contact heat exchange with steam that is directed through a steam coil disposed in the tray.

After the body of wax has been removed from the tray the removal of the lower melting point constituents is initiated by causing the temperature of the cell plates to be gradually increased, e.g., at the rate of about 1° to about 5° F. per hour, and this is continued until the temperature reaches a predetermined maximum which may, for example, be from about 2° to about 5° F. below the melting point of the wax. As the heating progresses, the oil and any other lower melting point constituents find avenues for readily draining through channels adjacent the plate surfaces, leaving the harder wax behind. During this period the separated oil is collected in the wax-receiving pan and is removed to a suitable container. Having extracted as much oil as may be regarded as practical for a single treating operation, the plates are then heated rapidly to a temperature of about 10° to about 20° F. above the melting point of residual hard wax. Under these conditions the cells are rapidly cleared and the deoiled wax is collected in the wax-receiving pan and recovered.

During a single deoiling operation the oil content of the original slack wax may be reduced by 40 – 80% of the original oil content. This may be accomplished in about 12 hours creating a by-product in the form of foots oil (heating oil or cracking stock).

The loss in the form of foots oil may be in the order of 30 to 50% of the weight of the original slack wax. The foots oil is largely a combination of oils and isoparaffins. The reduction of oil content accomplished varies with the original oil content of the slack wax. High oil contents in slack waxes, such as 30%, are less responsive to treatment than those having an oil content of 7 to 20%. As an oil content in the hard wax of less than 1% is desirable, the best ultimate yields of hard wax are obtainable by a second deoiling treatment carried out substantially in the same manner as the first deoiling treatment. Since the oil content in the hard wax has been substantially reduced by the first treatment, the amount of foots oil produced is much less in the second treatment. The decrease in weight in the second deoiling treatment will be substantially less than in the primary treatment. By performing two deoiling operations, each operation requiring about 12 hours' duration, it is possible to reduce the oil content of the residual hard wax to around 0.3% to 0.9%. The results may vary depending upon the original composition of the slack wax and the nature of the crystal structure produced in changing the slack wax from liquid phase to solid phase in the cells. The yields of hard wax with a certain oil content are of the same order as those obtained by the solvent extraction process but use much less costly processing equipment. The recovered wax, after conventional finishing treatment, fully meets industrial specifications for a wax of the type in question.

Further objects, features and advantages of this invention will become apparent in connection with the following description of an illustrative embodiment of the apparatus of this invention and the use thereof in practicing the method of this invention, wherein.

Figure 2:
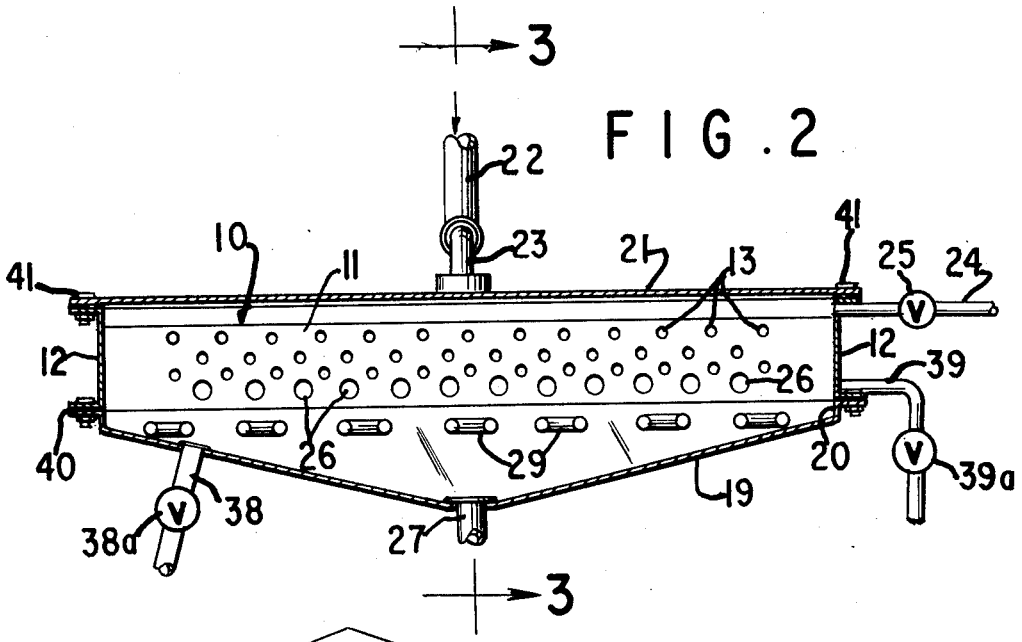
FIG. 2 is a section taken on the line 2—2 of FIG. 1.
Figure 1:
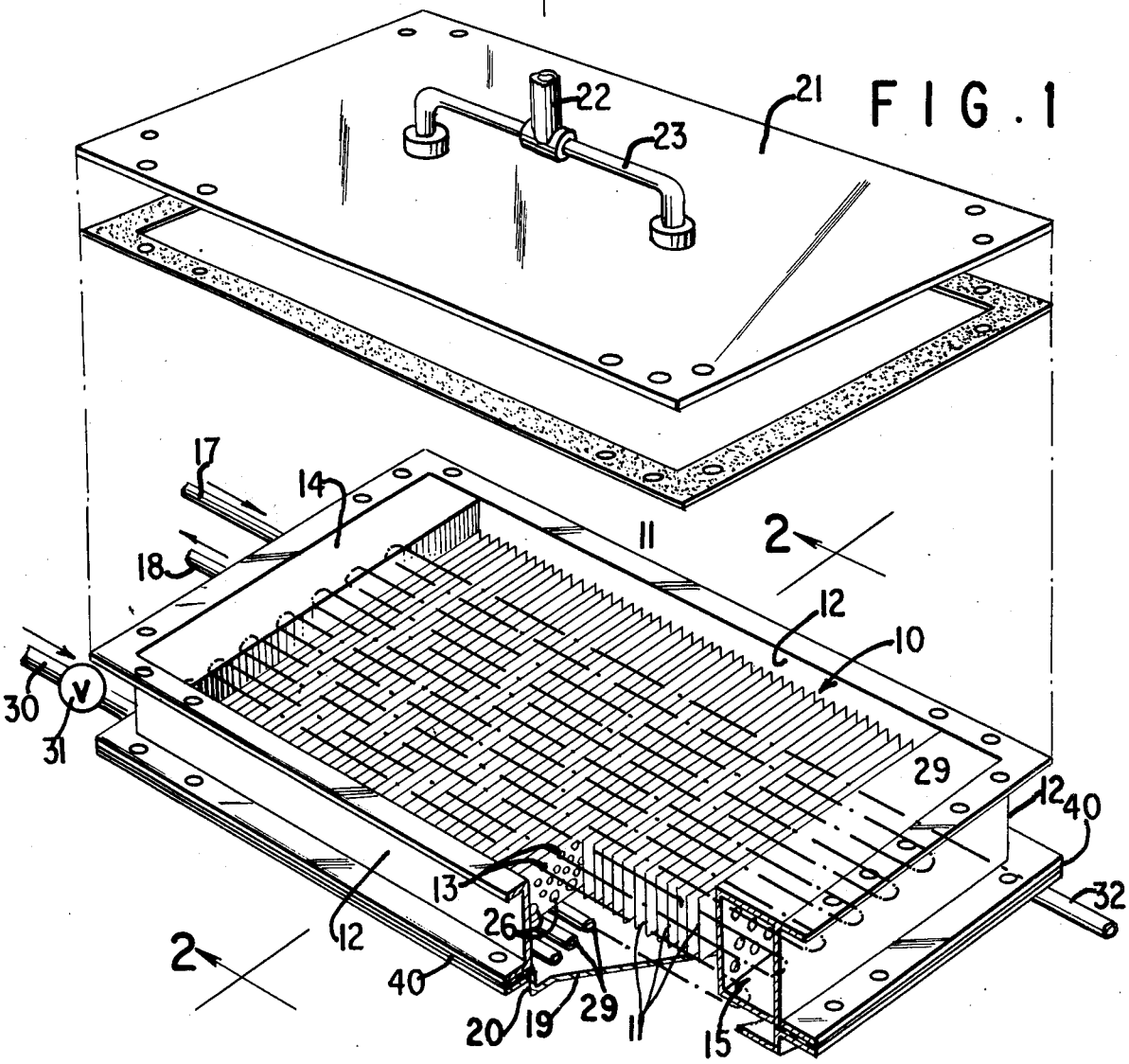
FIG. 1 is a perspective, partially exploded view of a deoiling unit embodying this invention with portions broken away to show the construction.
Figure 3:
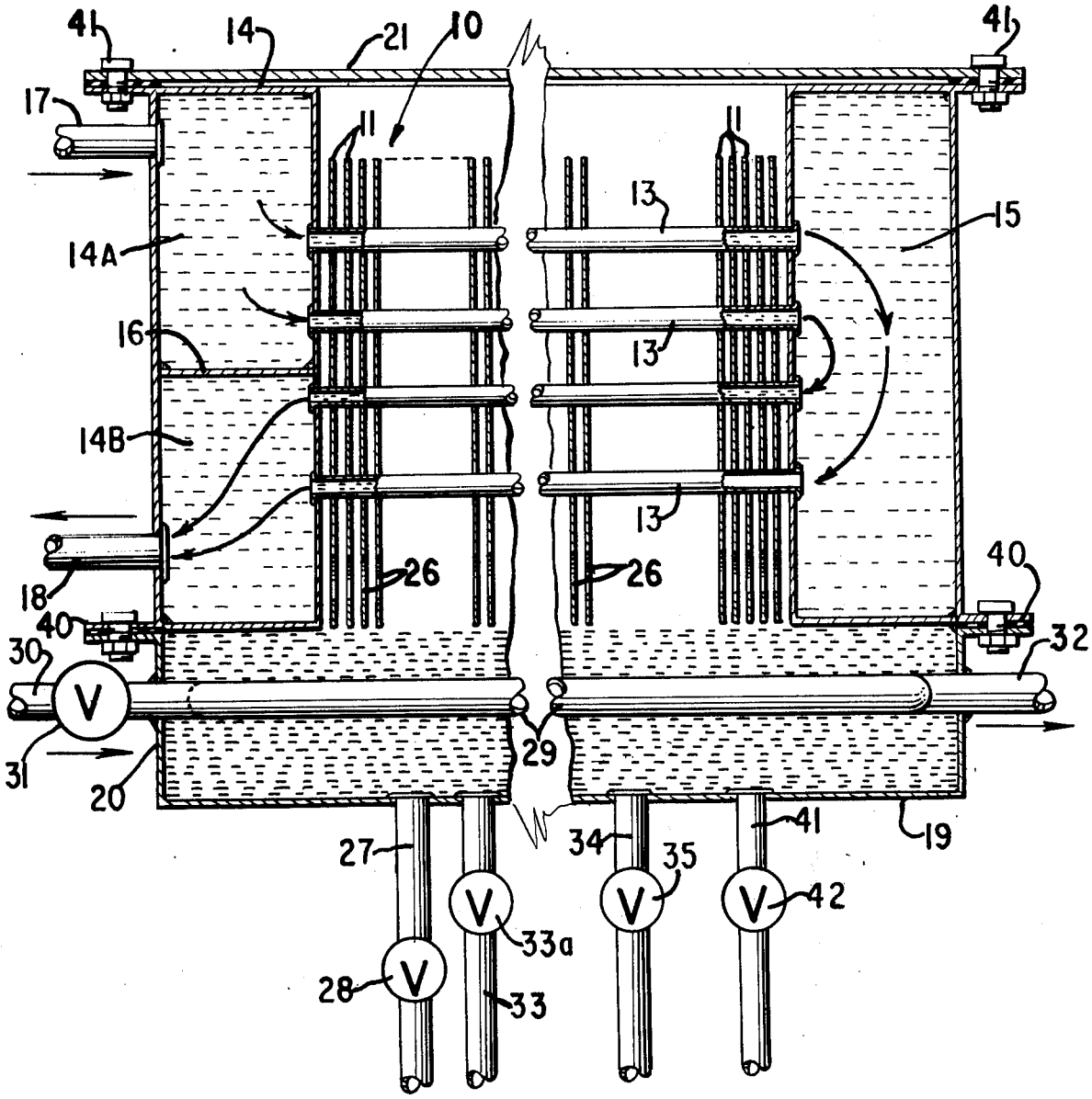
FIG. 3 is a section on an enlarged scale with the central portion broken away taken on the line 3—3 of FIG. 2.

The cell battery is indicated generally by the reference character 10. It comprises a succession of sheets or plates 11 which extend between the side walls 12. In the illustrative embodiment shown the plates are spaced from each other by a distance of one-eighth inch and the width from top to bottom is 8 inches. Twenty-gauge aluminum sheeting, for example, affords a preferred material for the cell plates. The plates 11 and the cell spaces between them are traversed by a plurality of conduits 13 for a temperature-controlling fluid, which ordinarily is water. In the embodiment shown the conduits are copper tubes having an inside diameter of about three-eighths inch. These conduits are distributed throughout the lateral area of the plates 11 and since they are in heat-conductive relation therewith the temperature of the plates 11 may be controlled and adjusted substantially uniformly throughout. There is, therefore, a large heat-conductive surface area which transmits heat rapidly and provides a largely uniform temperature throughout the mass of confined wax in the cells of the battery. At one end the conduits 13 open into a header 14 and at the other end they open into a header 15 so that the temperature-controlling fluid may be caused to flow through the conduits. In the embodiment shown the header 14 comprises an upper portion 14A and a lower portion 14B, which portions are separated from each other by the plate 16. As shown, the temperature-controlling fluid is introduced into the header portion 14 by the inlet line 17. The header 15 is a return flow header which directs the temperature-controlling fluid so that there is a return flow through the conduits 13 which communicate with the header portion 14B. The temperature-controlling fluid flows out through the outlet line 18. Ordinarily the temperature-controlling fluid is water and it is supplied from a reservoir which is provided with conventional equipment for varying the water temperature as desired such as that described in our aforesaid application Ser. No. 484,217.

Situated below the cell battery 10 there is a tray or pan 19, the bottom of which is substantially spaced from the lower margins of the plates in the cell battery. To facilitate drainage from the pan it may be sloped as illustrated in FIG. 2. In the embodiment shown the side walls 20 of the pan are integrally united with the side walls of the cell battery. The integral union between them may be accomplished by formation from continuous sheet material such as sheet steel or by a gasketed flange and bolt union 40 or any other union such as welding. The walls 20 of the pan at the end also are integrally united in similar manner with the headers 14 and 15. Accordingly, the cell battery and the pan provide in effect a single container which is traversed by the plates of the cell battery. Preferably there is a cover 21 which overlies the cell battery and is substantially spaced from the upper margins of the plates so as to facilitate distribution of the wax among the spaces between the plates. It may be secured in place by the gasketed flange and bolt union 41 as indicated or in any other convenient way. In the embodiment shown the wax is introduced into the unit through the line 22 which may be provided with a distributor 23 which is desirable in order to better distribute the wax as it is being introduced into the space between the cover 21 and the upper margins of the plates and into the spaces between the plates. The wax may be supplied by any suitable means (not shown), such as a pump which pumps the wax in the melted condition from a suitable heating tank in which the wax is maintained at the temperature at which the wax in the melted state is introduced into the plate battery. For example, a wax heating tank and associated mechanisms as disclosed in said application Ser. No. 484,217 may be employed.

In carrying out the invention using the equipment shown in the drawings, the wax in the melted state is introduced as by the line 22 while the outlets from the pan 19 are closed. As the wax is introduced, it forms a body of wax within the pan below the lower margins of the plates which, as it comes in contact with the lower margins of the plates, closes them off so that upon continued introduction of the melted wax the spaces between the plates become filled with the wax. In order to determine when the spaces between the places have been filled to desired depth, an overflow line 24 controlled by valve 25 may be used so that the level of the wax is approximately that of the upper margins of the plates. Any wax which overflows through the outlet 24 may be returned to the tank from which the melted wax is supplied or utilized in any other desired way. Uniform filling of the individual cells is promoted by the provision in the plates 11 of the openings 26 which permit the wax to flow from one cell to the other so that the wax in the various cells will assume the same level.

When all the cells in the battery have been filled to the desired level with the wax, cold water is caused to flow through the conduits 13 in the cell battery so as to lower the temperature in the plates and correspondingly lower the temperature of the wax confined between the plates. In the embodiment shown cold water is pumped by a suitable pump (not shown) through the inlet line 17 into the header 14A for passage through the plurality of conduits 13 prior to discharge from header 14B through the outlet line 18. For example, a source of water at different desired controlled temperatures may be employed such as that disclosed in said application Ser. No. 484,217. However, other conventional equipment for supplying water at different controlled temperatures may be employed. When the wax in the spaces between the plates has become solidified the body of wax in the pan 19 that underlies the lower margins of the plates is removed through the wax outlet line 27 that is controlled by the valve 28. In order to assist the flow of wax through the outlet 27, the body of wax in the pan may be heated as by the use of steam which is fed into the steam coil 29 through the steam inlet line 30 that is controlled by the valve 31. Any other heating element such as an electrical heating element may be used instead of the steam coil. Residual steam and any condensate is removed from the coil 29 through the outlet 32. Since the wax between the plates in the cell battery is maintained in a solid state by the cold water passed through the conduits 13, the wax remains in the spaces between the plates. The body of wax removed from the pan may be directly or indirectly returned to the wax heating tank from which melted wax is taken for introduction into the cell battery or it may be utilized in any other way.

The battery of cells has now been prepared for the removal of the lower melting point constituents of the wax by appropriate and controlled heat treatment. To this end, the water circulated through the conduits 13 is adjusted to a temperature which, for example, may be about 10° below the melting point of the wax. The water passed through the conduits 13 is thereafter gradually increased in temperature at a predetermined rate, which varies from about 1° to about 5° per hour. As the temperature of the wax in the cell battery 10 is gradually increased responsive to the gradual increase in the temperature of the plates, which in turn respond to the temperature of the water, the lower melting point constituents such as oil and isoparaffins begin to drain from the confined wax transversely across the width of the respective plates so as to flow down by gravity and ultimately drain from the lower margins of these plates into the pan below. At this point the valve 28 in the wax outlet line 27 is closed and flow from the pan 19 is only permitted to occur through the line 33 controlled by the valve 33*a*, thereby allowing the oil mixture to be discharged into a suitable foots oil storage tank (not shown). The gradual heating of the wax is continued until the residual wax has the composition that is sought to be obtained. This composition corresponds with that which has been found to be desirable as the result of prior laboratory evaluations. Once the correct composition has been predetermined by laboratory evaluation commercial operations can readily be controlled so as to obtain the desired composition of the retained wax.

When the temperature for obtaining the desired wax composition has been attained the valve 33*a* controlling the removal of foots oil is closed and the temperature of the water that is caused to be flowed through the conduits 13 is rapidly increased to a temperature sufficiently above the melting point of the wax that remains in the battery so that the cells will become substantially cleared of any retained wax. The melted residual wax that drains into the pan 19 is removed from the pan through the line 34 controlled by the valve 35, the valve 33*a* in the foots oil line 33 being closed. The valve 35 in the finished wax line 34 is closed as soon as the pan has been completely drained. The finished wax is directed by the line 34, which preferably is a steam traced line, to a suitable holding tank for the finished wax from which it may be taken as desired for subsequent working up. The sequence having been completed, the heated water in the conduits 13 and in the headers 14 and 15 is removed and replaced by cold water whereupon the operations above-described may be repeated.

The wax deoiling operation hereinabove described constitutes the preferred practice of the invention whereby the wax in the cells between the plates may be filled to desired level while leaving the spaces between the plates open at the bottom to permit free drainage by the expedient of causing the spaces between the plates to be closed off by a body of the same wax. However, as hereinabove stated, this invention comprehends the utilization of any body of a liquid material which is compatible with the wax and is immiscible with the wax by its introduction into the pan portion of the container into contact with the lower margins of the plates so as to close off the spaces between the plates and thereby prevent the escape of melted wax introduced between the plates. For example, if desired the unit hereinabove described may be used by introducing water at about 70° F. into the pan 19 through the water inlet line 38 controlled by valve 38*a* until the level of the water is at or adjacent the lower margin of the plates 11, which level can be controlled by the water outlet line 39 controlled by the valve 39*a*. When the pan 19 has thus been filled with water, the wax, being insoluble in water and of lower specific gravity, is retained in the spaces between the plates. Of course, after the spaces between the plates have been filled with wax in the melted condition and the wax has been reduced to the solid state by flow of cold water through the conduits 13 so as to be retained between the plates, the water may be drained from the pan 19 by the line 41 controlled by the valve 42. If any other body of liquid were to be used the liquid should be compatible with the wax and lacking in any substantial mutual solubility. Moreover, the liquid should be used in such condition that the melted wax between the cells will be retained within the cells.

While the practice of this invention has been described in connection with a single unit containing a single battery of cells provided with an underlying tray or pan, it is apparent that in an ordinary operation on a commercial scale it is consistent with economy to employ a number of units each comprising a cell battery and its associated underlying tray. In such case the units would ordinarily be subject to common control for accomplishing the supply and removal of the materials as hereinabove described in connection with a single unit.

In typical practice of this invention a slack wax having an oil content of 8–9% and a melting point of about 124° F. (ASTM-D-87-66) and a penetration at 77° F. of 30/32 (ASTM-D-1321-70) was subjected to deoiling in a cell battery wherein the separation of the plates was one-sixteenth inch. The wax was introduced at a temperature of 140° F. and reduced to the solid state by cooling to 100° F. Deoiling was accomplished by increasing the temperature of the temperature-controlling fluid at the varying rate of 1° to 5° F. per hour over a period of 12 hours. At the conclusion of the 12-hour period the deoiled wax had an oil content of 1.13%. When the deoiled wax was mixed with a second quantity of similarly produced deoiled wax and the mixture was subjected to a similar deoiling procedure the oil content became reduced to 0.49%. When the same slack wax in the form of a block 8 × 8 × 8 was subjected to conventional sweating, the oil content after 30 hours of sweating was about 1.26%. When the same slack wax was subjected to laboratory scale solvent extraction deoiling using a 3:1 solvent ratio (50% methylethylketone and 50% toluol), the oil content after a first extraction was 1.77% and after a repeat extraction was 0.86%.

It is apparent from the foregoing that as compared with conventional was sweating procedure the present invention enables the oil to be removed much more efficiently and with better yield. As compared with solvent extraction, the present invention enables oil to be removed with substantially greater effectiveness. This may be accomplished commercially at approximately the same operating cost. While as compared with solvent extraction the time required for deoiling a given amount of slack wax is somewhat greater, this is more than offset by the fact that for a given throughput the expense for plant installation is much less than that for a solvent extraction deoiling system. It also is important commercially that the equipment requirements for the practice of this invention can be scaled up or down roughly in proportion to difference in throughput capacity whereas the equipment used for solvent extraction does not lend itself to scaling down without a disproportionate increase in cost.

What is claimed is:

1. In a method of separating lower melting point constituents from higher melting point constituents contained in a wax composition wherein said wax composition is confined in solid state between a succession of vertically disposed plates and said lower melting point constituents are removed therefrom by gradually increasing the temperature of said plates responsive to controlled increase in the temperature of a fluid flowed through a multiplicity of conduits that traverse said spaces and said plates in thermally conductive relation to said plates with concomitant increase in the temperature of said wax composition confined between said plates accompanied by drainage of said lower melting point constituents from said composition, the improvement which comprises introducing said wax composition in the melted state into spaces between the plates which are separated from each other by a distance of about one-sixteenth to one half-inch and into a container adapted and disposed to maintain a body of said wax composition that is of substantial depth below the lower margins of said plates until said container contains a body of said wax composition that is in contact with the lower margins of said plates and until the depth of the wax composition between said plates is between about 4 and about 24 inches, lowering the temperature of said plates with concomitant solidification of the wax composition in the spaces between said plates, removing said body of wax composition from said container while the wax composition in the spaces between said plates is in the solid state, gradually raising the temperature of said plates with concomitant rise in the temperature of the wax composition in said spaces accompanied by draining of lower melting point constituents from said spaces and recovering said lower melting point constituents that drain from said spaces separated from higher melting point constituents retained within said spaces and thereafter melting said higher melting point constituents and recovering them separated from said lower melting point constituents.

2. The method according to claim 1 wherein the thickness of said body of wax composition is from about one-eighth to one-fourth inch.

3. The method according to claim 2 wherein the depth of said wax composition confined between said plates is from about 4 to about 12 inches.

4. The method according to claim 1 wherein said wax composition is slack wax containing normal paraffin wax and other constituents of lower melting point and wherein during said gradual heating said lower melting point constituents are selectively drained from normal paraffin wax retained between said surfaces.

5. The method according to claim 1 wherein the removal of said wax from said container is assisted by heating said wax to a temperature above its melting point while maintaining the wax in the spaces between said plates at a temperature at which it is in the solid state.

6. In wax deoiling apparatus for separating lower melting point constituents from higher melting point constituents which comprises a succession of plates having vertically disposed spaces therebetween, a plurality of conduits that successively pass through said plates in thermally conductive relation therewith, means for directing a temperature-controlling fluid through said conduits and means for regulating the temperature of said fluid, the improvement which comprises a battery of said plates which are spaced from each other by a distance between one-sixteenth and one-half inch and which are adapted to confine therebetween a body of wax composition about 4 to 24 inches in width extending upwardly from adjacent the lower margins of said plates, a container disposed underneath said battery the bottom of which is substantially spaced from the lower margins of said plates, means for introducing wax composition in the melted state into said container and into the spaces between said plates so as to fill said container with a body of wax composition in contact with the lower margins of said plates and to fill said spaces between said plates with said wax composition to a depth of from about 4 to about 24 inches, means for directing said temperature-controlling fluid through said conduits at a temperature which lowers the temperature of said plates to a temperature at which said wax composition is in the solid state, means for removing said body of wax composition from said container while the wax composition that is confined in the spaces between said plates is in the solid state, means for thereafter gradually increasing the temperature of said temperature-controlling fluid with concomitant gradual heating of the wax composition in the spaces between said plates to a temperature at which lower melting point constituents drain into said container, leaving the higher melting point constituents retained between said plates, and means for directing away and recovering said lower melting point constituents drained into said container.

7. Apparatus according to claim 6 which comprises a heating element disposed in said container underneath the lower margins of said plates and means for actuating said heating element to heat wax composition in said container to a temperature at which it is sufficently fluid for removal from said container in fluid condition while wax composition confined in the spaces between said plates remains in the solid state.

8. Apparatus according to claim 7 wherein said means for regulating the temperature of said temperature-controlling fluid is adapted to raise the temperature of said plates to a temperature at which the residual higher melting point constituents are melted and drain into said container, and means for directing away and collecting said higher melting point constituents drained into said container separately from said lower melting point constituents and separately from said wax composition removed from said container.

* * * * *